US006961408B2

(12) United States Patent
Harding et al.

(10) Patent No.: US 6,961,408 B2
(45) Date of Patent: Nov. 1, 2005

(54) DEVICE FOR GENERATING X-RAYS HAVING A LIQUID METAL ANODE

(75) Inventors: Geoffry Harding, Hamburg (DE); Bernd David, Huettblek (DE); Axel Thran, Hamburg (DE); Jens Peter Schlomka, Hamburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/506,949

(22) PCT Filed: Feb. 26, 2003

(86) PCT No.: PCT/IB03/00798

§ 371 (c)(1),
(2), (4) Date: Sep. 8, 2004

(87) PCT Pub. No.: WO03/077277

PCT Pub. Date: Sep. 18, 2003

(65) Prior Publication Data

US 2005/0175153 A1 Aug. 11, 2005

(30) Foreign Application Priority Data

Mar. 8, 2002 (EP) ..... 02075915

(51) Int. Cl.[7] ..... H01J 35/08

(52) U.S. Cl. ..... 378/143; 378/119; 378/140; 378/161

(58) Field of Search ..... 378/143, 140, 378/119, 161, 121, 130, 125, 126, 127

(56) References Cited

U.S. PATENT DOCUMENTS

| | | | | |
|---|---|---|---|---|
| 2,665,390 | A | 1/1954 | Zunick et al. | |
| 4,953,191 | A * | 8/1990 | Smither et al. | 378/143 |
| 5,052,034 | A * | 9/1991 | Schuster | 378/121 |
| 6,185,277 | B1 | 2/2001 | Harding | |
| 6,477,234 | B2 * | 11/2002 | Harding et al. | 378/141 |

FOREIGN PATENT DOCUMENTS

| | | |
|---|---|---|
| DE | 1 802 868 | 5/1970 |

* cited by examiner

*Primary Examiner*—Edward J. Glick
*Assistant Examiner*—Irakli Kiknadze

(57) ABSTRACT

The invention relates to a device for generating X-rays (31). The device has a source (5) for emitting electrons (27) accommodated in a vacuum space (3). The X-rays are emitted by a liquid metal as a result of the incidence of the electrons. The liquid metal flows through a constriction (13) where the electrons emitted by the source impinge upon the liquid metal. The constriction is bounded by a thin window (23), which is made from a material which is transparent to electrons and X-rays and which separates the liquid metal in the constriction from the vacuum space, and by a wall (25) opposite to the window. According to the invention, the wall (25) has a profile (p) which matches a profile (p') which the window (23) has, during operation, as a result of a deformation of the window caused by a pressure of the liquid metal in the constriction (13). Thus, it is achieved that the constriction has a predetermined intended cross-sectional area, and a decrease of the flow velocity and an accompanying excessive increase of the pressure at the location of the deformation of the window are prevented.

11 Claims, 5 Drawing Sheets

DEVICE FOR GENERATING X-RAYS HAVING A LIQUID METAL ANODE

Figure 1:
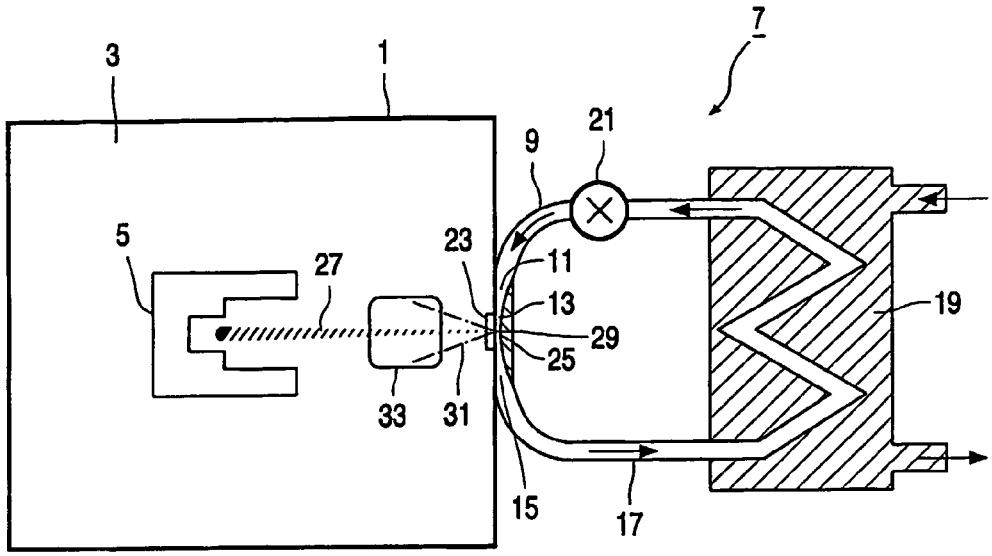

The invention relates to a device for generating X-rays, which device comprises a source for emitting electrons accommodated in a vacuum space, a liquid metal for emitting X-rays as a result of the incidence of electrons, and a pumping means for causing a flow of the liquid metal through a constriction where the electrons emitted by the source impinge upon the liquid metal, said constriction being bounded by a window, which is transparent to electrons and X-rays and separates the constriction from the vacuum space, and by a wall opposite to the window.

A device for generating X-rays of the kind mentioned in the opening paragraph is known from U.S. Pat. No. 6,185,277-B1. The window of the known device is relatively thin and is made from a material which is transparent to electrons and X-rays, e.g. diamond or molybdenum. The window prevents the vacuum space from being contaminated by the liquid metal. During operation of the known device, the liquid metal, e.g. mercury, flows through the constriction, which forms part of a closed channel system. The source generates an electron beam, which passes through the window and impinges upon the liquid metal in an impingement position in the constriction. The X-rays, emitted by the liquid metal as a result of the incidence of the electron beam, emanate through the window and through an X-ray exit window, which is provided in a housing enclosing the vacuum space. The velocity of the flow of the liquid metal in the constriction is relatively high, so that said flow is turbulent. As a result the heat, which is generated in the impingement position as a result of the incidence of the electron beam upon the liquid metal, is transported away from the impingement position by the flow of the liquid metal in an effective manner. As a result, an increase of the temperature of the liquid metal in the impingement position is limited, and a relatively high energy level of the electron beam is allowed without causing excessive heating of the liquid metal. The closed channel system of the known device further comprises a heat exchanger by means of which the liquid metal is cooled down.

A disadvantage of the known device for generating X-rays is that the relatively thin window is deformed during operation as a result of a pressure of the liquid metal in the constriction. As a result of the deformation of the window, the cross-sectional area of the constriction increases at the location of the deformation. Said increased cross-sectional area causes a reduction of the velocity of the flow of the liquid metal at the location of the deformation. As a result of the Bernoulli effect, said reduction of the flow velocity causes an increase of the pressure of the liquid metal at the location of the deformation, which pressure increase is comparatively high as a result of the high density of the liquid metal. As a result of said pressure increase, a further deformation or even breakage of the thin window occurs.

It is an object of the invention to provide a device for generating X-rays of the kind mentioned in the opening paragraph in which an increase of the pressure of the liquid metal in the constriction as a result of a deformation of the window is limited or even prevented, so that the rate of deformation of the window is considerably reduced and breakage of the window is prevented as much as possible.

In order to achieve said object, a device for generating X-rays according to the invention is characterized in that, at least during operation, said wall has a profile which matches a profile which the window has, during operation, as a result of a deformation of the window caused by a pressure of the liquid metal in the constriction.

The invention is based on the insight that a deformation of the window under the influence of the pressure of the liquid metal cannot be avoided, because the window should be relatively thin to obtain sufficient transparency to electrons and because a vacuum is present at one side of the window. Since, according to the invention, the wall opposite to the window has a profile which matches the profile which the window has, during operation, as a result of the deformation of the window, it is achieved that a cross-sectional area of the constriction in the deformed state of the window, i.e. during operation, substantially corresponds with an intended, desired cross-sectional area, which the constriction would have if the window was not subject to deformation and if the wall did not have said profile. As a result, the flow velocity and hence the pressure of the liquid metal at the location of the deformation substantially correspond with an intended flow velocity and pressure, which the liquid metal would have if the window was not subject to deformation and if the wall did not have said profile. Accordingly, an increase of the pressure of the liquid metal at the location of the deformation of the window is considerably limited or even prevented, as a result of which the rate of deformation of the window and the risk of breakage of the window are considerably reduced.

It is noted that the expression "matches" in claim 1 is not meant to be limited to "is identical to" or "corresponds with". Accordingly, the invention does not only cover embodiments in which, during operation, the constriction has a constant cross-sectional area, seen in a flow direction, but also embodiments in which, during operation, the constriction has a cross-sectional area which changes in a predetermined intended manner in the flow direction. Therefore, the expression "matches" generally intends to indicate that the profile of the wall opposite to the window is determined by, approximates, or corresponds with the profile of the deformed window in such a manner that the cross-sectional area of the constriction in the deformed state of the window, i.e. during operation, substantially corresponds with, and accordingly also might change, seen in the flow direction, in a manner corresponding with an intended cross-sectional area, which the constriction would have if the window was not subject to deformation and if the wall did not have said profile.

A particular embodiment of a device according to the invention is characterized in that said wall is deformable by means of at least one actuator, the device comprising at least one pressure sensor for measuring the pressure of the liquid metal in the constriction and a control member for controlling the actuator as a function of a pressure measured by means of the sensor. In this embodiment, the actuator is for example controlled in such a manner, and as a result the wall opposite to the window is given such a profile, that the pressure measured by the sensor is maintained at a value corresponding with an intended pressure, which the liquid metal would have if the window was not subject to deformation and if the wall did not have said profile. Alternatively, the actuator is for example controlled in such a manner that the pressure of the liquid metal in the constriction does not exceed a predetermined safety value. Preferably, a plurality of sensors are used, so that the pressure can be measured in a plurality of locations in the constriction, and a plurality of actuators are used, so that the profile of the wall opposite to the window can be adjusted in each location where the pressure is measured.

A further embodiment of a device according to the invention is characterized in that said actuator is a piezo-electric actuator. The piezo-electric actuator is suitable for generating relatively small and accurate deformations of the wall opposite to the window, so that the profile of the wall can be adjusted very accurately. In addition, the piezo-electric actuator can also be used as a pressure sensor, so that the structure of the device is considerably simplified.

A particular embodiment of a device according to the invention is characterized in that in the case of a deformation of the window, during operation, the constriction has a cross-sectional area which, seen in a flow direction, increases in such a manner that a reduction of the flow velocity in the flow direction takes place such that a decrease of the pressure of the liquid metal in the constriction, caused by viscous flow losses, substantially corresponds with an increase of said pressure caused by said reduction of the flow velocity. If the constriction had a constant cross-sectional area, seen in the flow direction, the liquid metal would flow through the constriction at a velocity which is substantially constant in the flow direction, and the pressure of the liquid metal would decrease, seen in the flow direction, as a result of viscous flow losses. As a result, a relatively high pressure would be necessary at the entrance of the constriction in order to achieve a certain minimal pressure at the end of the constriction, which is necessary to maintain a steady flow of the liquid metal throughout the constriction. Said high pressure at the entrance of the constriction and the accompanying pressure gradient between the entrance and the end of the constriction would cause a high mechanical load on the window, as a result of which the risk of breakage of the window would strongly increase. In this particular embodiment, the profile of the wall opposite to the window is such that, in the case of a deformation of the window, during operation, the decrease of the pressure of the liquid metal in the flow direction, caused by the viscous flow losses, is substantially compensated by the increase of the pressure in the flow direction, caused by the increase of the cross-sectional area and the accompanying decrease of the flow velocity. Said increase of the pressure is a result of the Bernoulli effect. As a result, the pressure of the liquid metal is substantially constant throughout the constriction and can be maintained at a relatively low level by a suitable design of the dimensions of the entire flow channel of the device and by a suitable flow rate of the liquid metal. As a result, the mechanical load on the window is relatively low.

A particular embodiment of a device according to the invention is characterized in that the device is provided with a flow channel for the liquid metal which successively comprises, seen in a flow direction, a converging part, said constriction, and a diverging part, wherein a center line of at least a portion of said converging part, via which the converging part is connected to the constriction, has a curvature which matches a curvature of a center line which the constriction has, during operation, in the case of a deformation of the window. In the case of a deformation of the window during operation, the constriction bounded by the deformed window and by the profiled wall opposite to the window is curved, seen in the flow direction. As a result, a curved flow is present in the constriction. An advantage of the curved flow is that the flow has a component in a direction transverse to the main flow direction caused by centrifugal forces. As a result of said transverse component, the heat generated in the impingement position is more effectively distributed over the liquid metal flowing through the constriction, so that the transfer of heat away from the impingement position is improved. Since the center line of at least the portion of the converging part, via which the converging part is connected to the constriction, has a curvature which matches the curvature of the center line of the constriction, the curved flow in the constriction is already initiated in the converging part. As a result, the rate at which the curved flow and in particular said transverse component will further develop in the constriction is considerably increased, so that the heat transfer away from the impingement position is further improved.

A particular embodiment of a device according to the invention is characterized in that the device is provided with a flow channel for the liquid metal which successively comprises, seen in a flow direction, a converging part, said constriction, and a diverging part, wherein the converging part is provided with means for generating or increasing a turbulence of the flow of the liquid metal in the constriction. As a result of said turbulence or increased turbulence of the flow of the liquid metal in the constriction, the heat generated in the impingement position is more effectively distributed over the liquid metal flowing through the constriction, so that the transfer of heat away from the impingement position is further improved.

A particular embodiment of a device according to the invention is characterized in that a center line, which the constriction has during operation as a result of said deformation of the window, is convex, seen from the source. In this embodiment, the window and the impingement position, which is present at a relatively small distance below the window, are situated at an outer radius of the curved constriction. At said outer radius, the local velocity in the main flow direction is relatively high as a result of the fact that the liquid metal is forced towards said outer radius by centrifugal forces. As a result, the transport of heat away from the impingement position is further improved.

A particular embodiment of a device according to the invention is characterized in that the window is concave, seen from the source. In this embodiment, the window is situated at an inner radius of the curved constriction. Since the centrifugal forces, which are exerted on the flow of liquid metal in the curved constriction, are directed towards the outer radius of the curved constriction, i.e. away from the inner radius, the mechanical load on the window and the risk of breakage of the window are further reduced.

A further embodiment of a device according to the invention is characterized in that the window is provided with corrugations. As a result of said corrugations, the mechanical strength of the window is improved. In this manner, the window is better protected against damage or breakage, in particular when the device is started or stopped, in which cases the pressure of the liquid metal in the constriction can rise to values which are considerably higher than the value during normal operation.

A yet further embodiment of a device according to the invention is characterized in that said corrugations extend in a flow direction of the liquid metal in the constriction. In this manner, the corrugations do not lead to flow irregularities at the location of the window, so that the transport of heat away from the impingement position is affected hardly, or not at all by the presence of the corrugations. Furthermore, in this embodiment the increase of the flow losses in the constriction as a result of the presence of the corrugations is limited.

A yet further embodiment of a device according to the invention is characterized in that the wall opposite to the window is provided with corrugations which correspond with the corrugations of the window and are in positions, seen in a direction perpendicular to the flow direction, identical to the positions of the corrugations of the window.

In this manner, the local distances between the window and the wall opposite to the window, seen in a direction perpendicular to the flow direction, are not influenced by the presence of the corrugations. As a result, the presence of the corrugations does not influence the cross-sectional area of the constriction, and hence does not lead to local deviations of the main flow velocity and pressure of the liquid metal.

Figure 2:
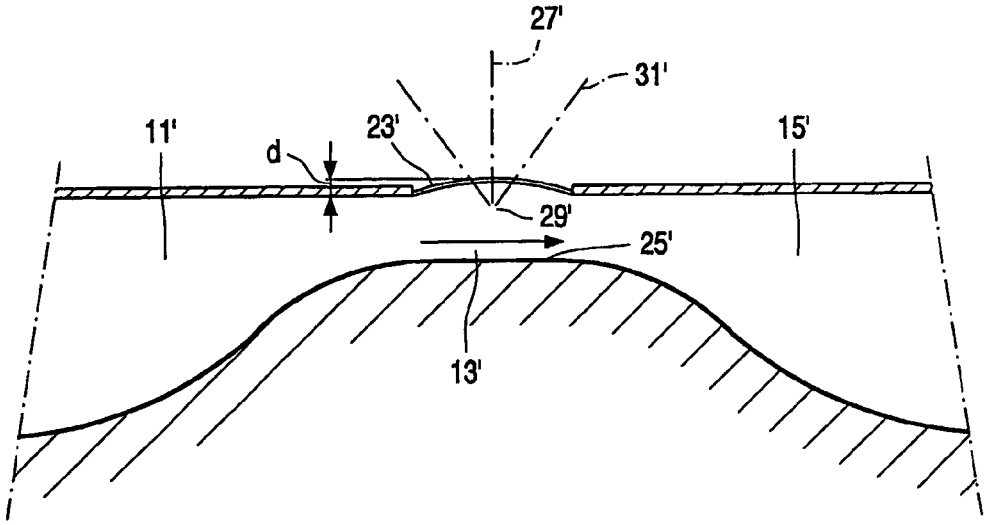
Figure 3:
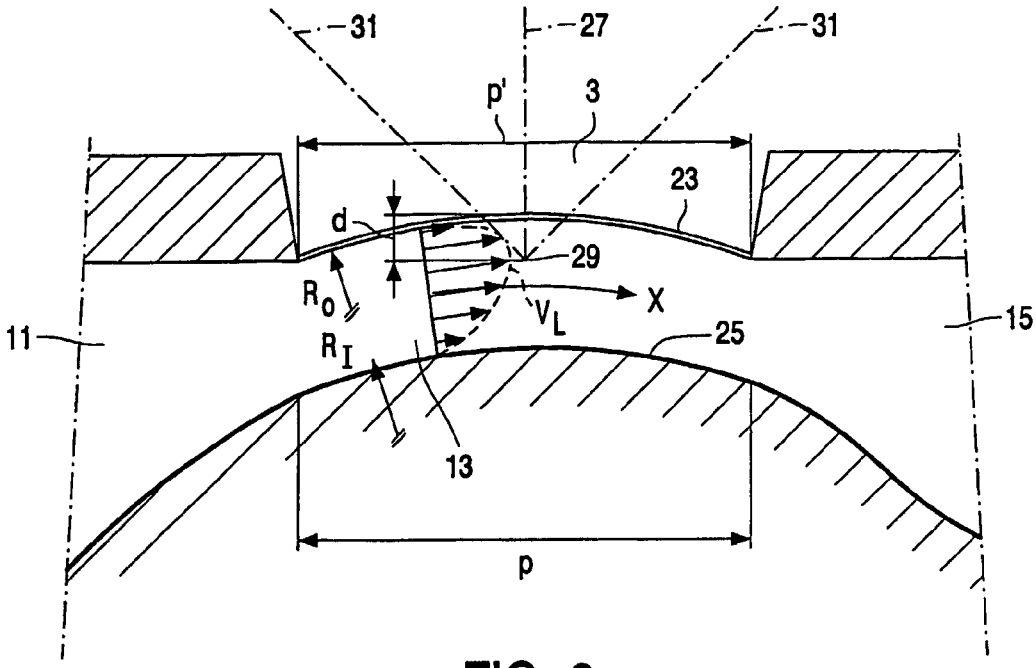
Figure 4:
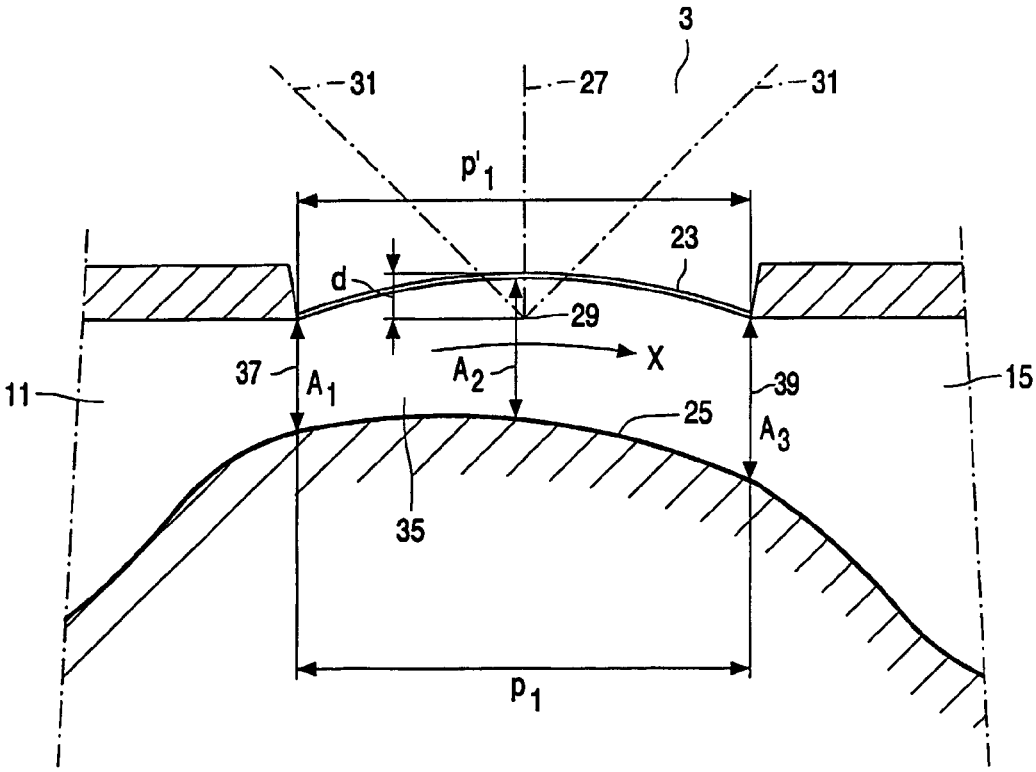
Figure 5:
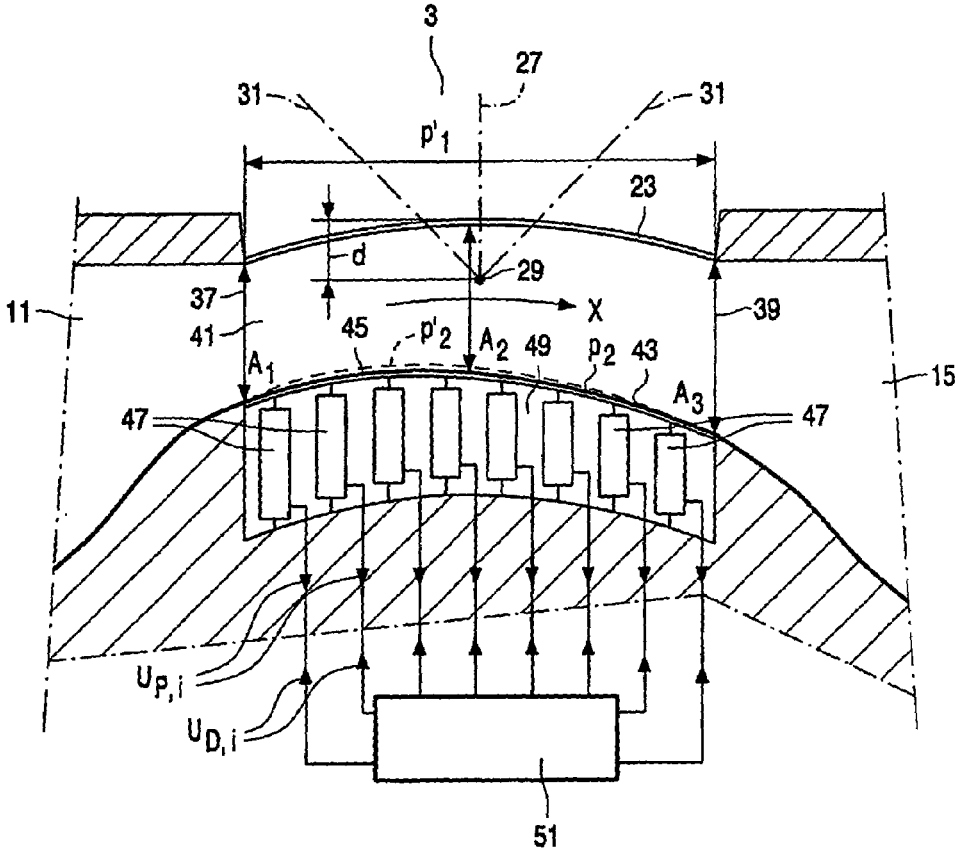
Figure 6:
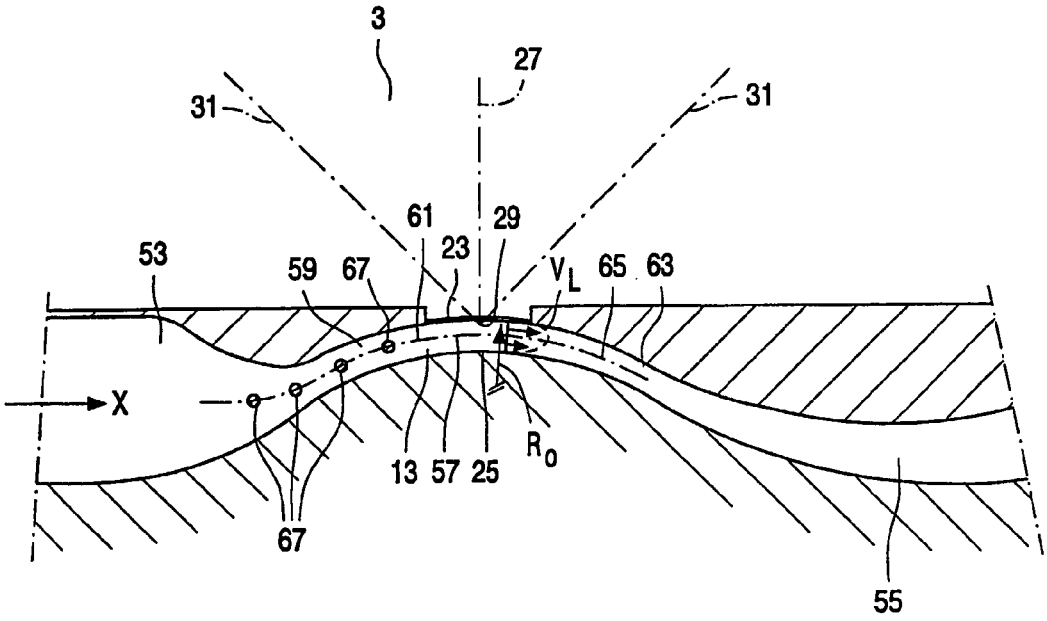
Figure 7:
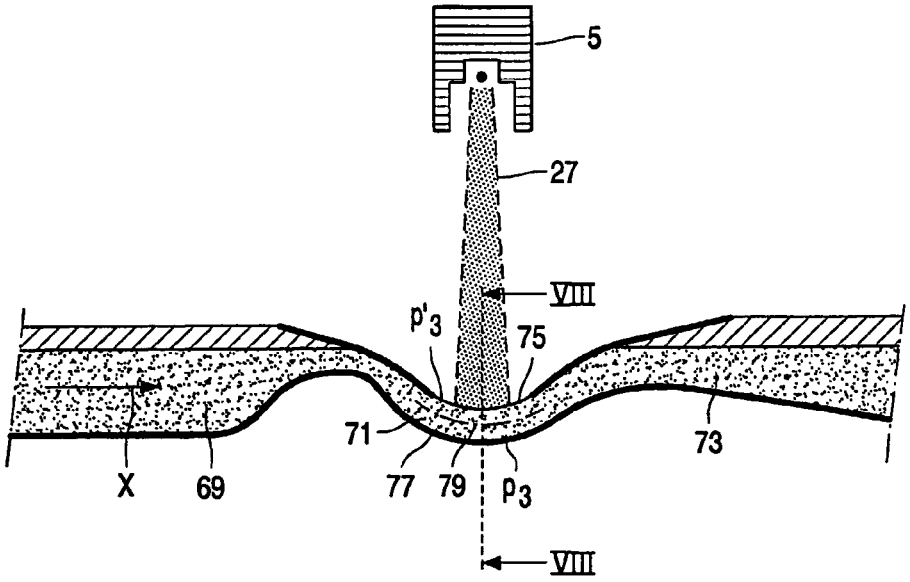
Figure 8:
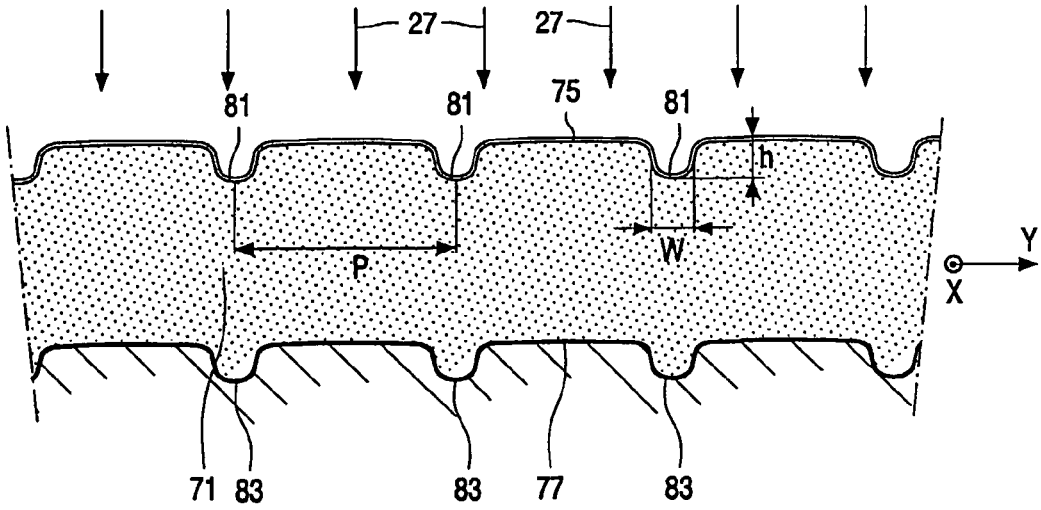
Figure 9:
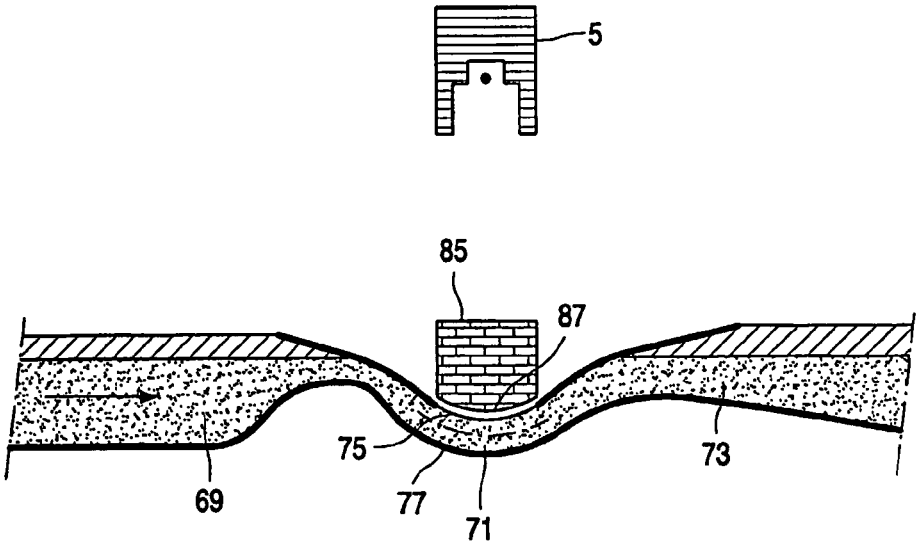

In the following, embodiments of a device for generating X-rays according to the invention will be explained further in detail with reference to the Figures, in which FIG. 1 schematically shows a first embodiment of a device for generating X-rays according to the invention, FIG. 2 shows a constriction of a device similar to the device of FIG. 1, but without a profiled wall bounding said constriction, FIG. 3 shows, during operation, a constriction with a profiled wall of the device of FIG. 1, FIG. 4 shows, during operation, a constriction with a profiled wall of a second embodiment of a device for generating X-rays according to the invention, FIG. 5 shows, during operation, a constriction with a profiled wall of a third embodiment of a device for generating X-rays according to the invention, FIG. 6 shows, during operation, a converging part, a constriction, and a diverging part of a fourth embodiment of a device for generating X-rays according to the invention, FIG. 7 shows, during operation, a converging part, a constriction, and a diverging part of a fifth embodiment of a device for generating X-rays according to the invention, FIG. 8 shows a cross-section along the line VIII—VIII in FIG. 7, and FIG. 9 shows the device of FIG. 7 provided with an alternative solution to prevent buckling of the window bounding the constriction.

In FIG. 1 only the main components of the first embodiment of a device for generating X-rays according to the invention are schematically shown. The device comprises a housing 1 which encloses a vacuum space 3 in which a source 5 or cathode for emitting electrons is accommodated. The device further comprises a closed channel system 7 comprising an inlet channel 9, a converging part 11, a constriction 13, a diverging part 15, an outlet channel 17, a heat exchanger 19, and a hydraulic pump 21. The channel system 7 is filled with a liquid metal which has the property of emitting X-rays as a result of the incidence of electrons. In the embodiment shown, the liquid metal is an alloy of Ga, In, and Sn, but also other kinds of metals or metal alloys which are liquid at room temperature, such as for example Hg, may be used. The constriction 13 is bounded by a window 23, which is transparent to electrons and X-rays, and by a wall 25 opposite to the window 23. In the embodiment shown, the window 23 comprises a relatively thin diamond plate, but also other kinds of materials which are sufficiently transparent to electrons and X-rays, such as for example Mo, may be used. The window 23 separates the constriction 13 from the vacuum space 3, thereby preventing the vacuum space 3 from being contaminated by particles of the liquid metal.

During operation of the device, the liquid metal is caused to flow through the constriction 13 by means of the hydraulic pump 21. In the embodiment shown, the hydraulic pump 21 is of a conventional type, but also another suitable pumping means may be used instead, such as for example a magnetohydrodynamic pump. The constriction 13 has a relatively small cross-sectional area, so that the flow of the liquid metal in the constriction 13 has a relatively high velocity and is turbulent. The source 5 generates an electron beam 27, which passes through the window 23 and impinges upon the liquid metal in an impingement position 29 in the constriction 13. As a result of the incidence of the electron beam 27 upon the liquid metal, X-rays 31 are generated in the impingement position 29. Thus, the liquid metal in the constriction 13 constitutes an anode of the device for generating X-rays. The X-rays 31 emanate through the window 23 and through an X-ray exit window 33, which is provided in the housing 1.

A further result of the incidence of the electron beam 27 upon the liquid metal is the generation of a large amount of heat in the impingement position 29. This heat is transported away from the impingement position 29 in an effective manner by the flow of the liquid metal in the constriction 13, and the heated liquid metal is subsequently cooled down again in the heat exchanger 19. In this manner, excessive heating of the liquid metal in the impingement position 29 and of the surroundings of the constriction 13 is prevented. By means of the flow of the liquid metal in the constriction 13, a relatively high rate of heat transport away from the impingement position 29 is achieved, so that a relatively high energy level of the electron beam 27 and consequently a relatively high energy level of the X-rays 31 is allowed.

In order to obtain a sufficiently high velocity of the liquid metal in the constriction 13 during operation, the pump 21 generates a relatively high pressure of the liquid metal. In the embodiment shown, a pressure in the order of 50–60 bar is generated in the inlet channel 9 to obtain a flow velocity in the order of 50 m/s in the constriction 13. In the embodiment shown, the constriction 13 has a height, i.e. a distance between the window 23 and the wall 25, of approximately 400 $\mu$m, a length in the flow direction of approximately 1,5 mm, and a width perpendicular to the flow direction of approximately 10 mm. As a result of the Bernoulli effect in the converging part 11, the pressure in the constriction 13 is in the order of 1 bar. As a result of the Bernoulli effect in the diverging part 15, the pressure in the outlet channel 17 is in the order of 40–45 bar, which is lower than the pressure in the inlet channel 11 as a result of viscous flow losses.

Under the influence of the pressure of the liquid metal in the constriction 13, the window 23 is deformed. A deformation of the window 23 cannot be avoided, because the window 23 should be sufficiently thin to achieve sufficient transparency to electrons and X-rays, and because at the side of the window 23 remote from the liquid metal a vacuum pressure is present. In the embodiment of FIG. 1, a maximal deformation in the middle of the window 23 is in the order of 30 $\mu$m. If the wall 25' opposite to the window 23' were straight, as shown in FIG. 2 which schematically shows a constriction 13' of a device not covered by the invention, the deformation of the window 23' would lead to an increase of the cross-sectional area of the constriction 13' at the location of the deformation. Said increase of the cross-sectional area would lead to a decrease of the flow velocity and, as a result of the Bernoulli effect, to an increase of the pressure at the location of the deformation. Said increase of the pressure would be relatively high as a result of the high density of the liquid metal. With a typical density in the order of 8000 kg/M$^3$, an increase of the pressure in the order of 10 bar would be obtained at the location of the maximal deformation in the middle of the window 23', which is indicated by the reference d in FIG. 2. Such an increase of the pressure would lead to a further inadmissible deformation of the window 23' or even to breakage of the window 23'.

In order to limit or even prevent an increase of the pressure of the liquid metal in the constriction 13 as a result of the deformation of the window 23, the wall 25 opposite to the window 23 has a profile p, as shown in FIG. 3, which corresponds with a profile p' which the window 23 has, during operation, as a result of the deformation of the window 23 caused by the pressure of the liquid metal in the constriction 13. In the embodiment shown, the wall 25 is relatively thick and made from a material having a relatively low transparency to X-rays, so that the profile p of the wall 25 is fixed. The profile p of the wall 25 corresponds with a profile which the window 23 would have if the pressure exerted on the window 23 corresponded with the pressure in an imaginary straight constriction, i.e. a constriction bounded by an undeformed straight window and by a straight wall opposite to the window. The profile p can be predetermined by means of, for example, a numerical calculation. In this way it is achieved that the cross-sectional area of the constriction 13 in the deformed state of the window 23 as shown in FIG. 3, i.e. during operation, substantially corresponds with the cross-sectional area of said imaginary straight constriction, i.e. the cross-sectional area of the constriction 13 is constant in the flow direction X. As a result, the flow velocity and hence the pressure of the liquid metal at the location of the deformation of the window 23 substantially correspond with the flow velocity and the pressure in said imaginary straight constriction, and accordingly an increase of the pressure of the liquid metal at the location of the deformation of the window 23 is limited or even absent.

FIG. 4 shows a constriction 35 of a second embodiment of a device for generating X-rays according to the invention. Parts of the second embodiment, which correspond with parts of the first embodiment as shown in FIGS. 1 and 3, are indicated by means of corresponding reference numbers. Apart from the constriction 35, the second embodiment substantially corresponds with the first embodiment, and therefore the other parts of the second embodiment are not shown in the Figures and will not be discussed. In the constriction 35, the wall 25 opposite to the window 23 has a profile $p_1$ which does not substantially correspond with the profile $p_1'$ which the window 23 has as a result of the deformation of the window 23 caused by the pressure of the liquid metal in the constriction 35, but which matches the profile $p_1'$ of the deformed window 23 in such a manner that a cross-sectional area of the constriction 35 gradually increases in the flow direction X. Thus, a cross-sectional area $A_1$ at the entrance 37 of the constriction 35 is smaller than a cross-sectional area $A_2$ at the location of the maximal deformation d in the middle of the window 23, and said cross-sectional area $A_2$ is smaller than a cross-sectional area $A_3$ at the end 39 of the constriction 35. If the viscous flow losses in the constriction 35 were zero, the flow velocity would gradually decrease in the flow direction X as a result of said increasing cross-sectional area and, as a result of the Bernoulli effect, the pressure of the liquid metal would gradually increase in the flow direction X. The profile $p_1$ of the wall 25 and as a result, in the deformed state of the window 23, the increase of the cross-sectional area of the constriction 35 in the flow direction X are such that a decrease of the pressure of the liquid metal in the flow direction X, caused by the viscous flow losses in the constriction 35, substantially corresponds with, and hence is substantially compensated by, said increase of the pressure in the flow direction X caused by the Bernoulli effect. As a result, the pressure of the liquid metal in the constriction 35 is substantially constant in the flow direction X, so that the window 23 is subjected to a uniform mechanical load. In this embodiment, by a suitable design of the dimensions of the entire channel system 7 and by a suitable flow rate of the liquid metal, a relatively low uniform pressure of less than 1 bar can be maintained during operation throughout the constriction 35, so that the mechanical load on the window 23 is further reduced. This pressure corresponds with a pressure in an imaginary constriction which is bounded by an undeformed window and by a wall opposite to the window which tapers relative to the window in the upstream direction.

FIG. 5 shows a constriction 41 of a third embodiment of a device for generating X-rays according to the invention. Parts of the third embodiment, which correspond with parts of the second embodiment as shown in FIG. 4, are indicated by means of corresponding reference numbers. Apart from the constriction 41, the third embodiment substantially corresponds with the second embodiment, and therefore the other parts of the third embodiment are not shown in the Figures and will not be discussed. In the constriction 41, the wall 43 opposite to the window 23 does not have a fixed profile like the walls 25 in the first and second embodiments described before. The wall 43 is a surface of a relatively thin metal plate 45 with, in the embodiment shown, a thickness of 200 $\mu$m. The plate 45 and accordingly also the wall 43 are deformable in a direction transverse to the flow direction X by means of a number of piezo-electric actuators 47, which are accommodated in a closed chamber 49 below the plate 45. In an undeformed state, the wall 43 has a profile $p_2$ which roughly corresponds with the profile $p_1$ of the wall 25 in the second embodiment. Thus, like the wall 25 in the second embodiment, the profile $p_2$ matches the profile $p_1'$ of the deformed window 23 in such a manner that a decrease of the pressure of the liquid metal in the flow direction X, caused by the viscous flow losses in the constriction 41, roughly corresponds with and hence is roughly compensated by, the increase of the pressure in the flow direction X, caused by the Bernoulli effect which is caused by the increasing cross-sectional area of the constriction 41 in the flow direction X.

The third embodiment further comprises a control member 51 which controls the actuators 47 as a function of a pressure of the liquid metal in the constriction 41 measured by means of a pressure sensor. In the embodiment shown, the piezo-electric actuators 47 are also used as pressure sensors, the actuators 47, periodically supplying electrical signals $u_{P,i}$, corresponding with a pressure exerted on the actuators 47 to the control member 51, and the control member 51 periodically supplying electrical signals $u_{D,i}$ corresponding with a deformation of the actuators 47 determined by the control member 51 in response to the signals $u_{P,i}$. The signals $u_{D,i}$ are determined by the control member 51 to be such, and accordingly the wall 43 is deformed to have such a profile $p_2'$, that the pressure of the liquid metal in the constriction 41, measured by each of the actuators 47, corresponds with a predetermined constant value below 1 bar. Thus, it is achieved that the pressure of the liquid metal in the constriction 41 is maintained at said predetermined value in a very accurate manner, particularly in case of deviations of the pressure and of the velocity in the converging part 11 and in case of deviations of the deformation of the window 23 caused by, for example, deviations of the temperature. The piezo-electric actuators 47 are suitable for generating relatively small and accurate deformations of the wall 43, so that the profile $p_2'$ of the wall 43 can be adjusted very accurately. In addition, the structure of the device is relatively simple in that the actuators 47 also constitute the necessary pressure sensors. It is however noted that the invention also comprises embodiments in which separate pressure sensors are used to measure the pressure of the liquid metal in the constriction 41, and/or in which another type of actuator is used. The invention also comprises embodiments in which the structure of the device is further simplified in that fewer actuators and pressure sensors, or even only one actuator and pressure sensor, for example only at the location of the maximal deformation d in the middle of the window 23, are used. The invention further comprises embodiments in which, instead of pressure sensors, sensors are used which measure the deformation of the window 23. In such an embodiment, the actuators 47 are controlled in such a manner that, during operation, the deformation of the window 23 corresponds with a predetermined intended deformation.

In the embodiments of FIGS. 1, 3, 4, and 5 described before, the window 23 is convex, seen from the source 5 and from the electron beam 27, as a result of the deformation of the window 23 during operation. Since, in these embodiments, the profile p, $p_1$, $p_2'$ of the wall 25, 43 opposite to the window 23 corresponds with or matches the profile p', $p_1'$ of the deformed window 23, the profile p, $p_1$, $p_2'$ of the wall 25, 43 and a center line, which the constriction 13, 35, 41 has as a result of the deformation of the window 23, are also convex, seen form the source 5. As a result, the flow of the liquid metal in the constriction 13, 35, 41 is curved during operation, the window 23 being present near an outer radius $R_O$ of the curved flow, and the wall 25 being present near an inner radius $R_I$ of the curved flow as shown in FIG. 3. In the curved flow a centrifugal force is exerted on the liquid metal, which urges the liquid metal towards the outer radius $R_O$ and accordingly causes a flow component in a direction transverse to the main flow direction X. As a result, as shown in FIG. 3, the local velocity $V_L$ in the main flow direction X is relatively high near the outer radius $R_O$. Since the impingement position 29 is present at a relatively small distance below the deformed window 23, i.e. near the outer radius $R_O$ where the local velocity $V_L$ is relatively high, the transport of heat away from the impingement position 29 is considerably improved as a result of the convex, curved flow.

FIG. 6 shows a converging part 53, a constriction 13, and a diverging part 55 of a fourth embodiment of a device for generating X-rays according to the invention. Parts of the fourth embodiment, which correspond with parts of the first embodiment as shown in FIGS. 1 and 3, are indicated by means of corresponding reference numbers. Apart from the converging part 53 and the diverging part 55, the fourth embodiment substantially corresponds with the first embodiment, and therefore the other parts of the fourth embodiment are not shown in the Figures and will not be discussed. The constriction 13 of the fourth embodiment corresponds with the constriction 13 of the first embodiment shown in FIG. 3, but another constriction within the scope of the invention, such as the constriction 35 of the second embodiment or the constriction 41 of the third embodiment, may be used instead. FIG. 6 further shows the center line 57 of the constriction 13, which is convex, as seen from the source 5 and the electron beam 27, as a result of the convex deformation of the window 23 during operation. In the fourth embodiment, the converging part 53 has a portion 59 via which the converging part 53 is connected to the constriction 13. As shown in FIG. 6, said portion 59 has a center line 61 with a curvature which matches the curvature of the center line 57, which the constriction 13 has, during operation, in the case of a deformation of the window 23. As a result, a curved flow, having a curvature corresponding with the curvature of the curved flow in the constriction 13, is also present in the portion 59 of the converging part 53. In this manner, the curved flow in the constriction 13 is already initiated in the portion 59 of the converging part 53. As a result, the flow component in the direction transverse to the main flow direction X will already arise in the portion 59 of the converging part 53 and will further increase in the constriction 13, so that the local velocity $V_L$ in the constriction 13 near the outer radius $R_O$ and accordingly also the rate of heat transfer away from the impingement position 29 will further increase.

In the fourth embodiment shown in FIG. 6, the diverging part 55 has a portion 63 via which the constriction 13 is connected to the diverging part 55. Said portion 63 has a center line 65 with a curvature which, like the center line 61 of the portion 59 of the converging part 53, matches the center line 57 of the constriction 13. As a result, the curved flow in the constriction 13 is maintained partially in said portion 63 of the diverging part 55. As a result, the curved flow in the constriction 13 is substantially not affected by the presence of the diverging part 55. It is noted, however, that the invention also covers embodiments in which only the curvature of the center line 61 of the portion 59 of the converging part 53 matches the curvature of the center line 57 of the constriction 13. In such an embodiment, the curved flow near the end of the constriction 13 might be slightly affected by the presence of the diverging part 55, but the advantages of a curved flow are still achieved in a relatively large portion of the constriction 13.

As discussed before, the flow velocity of the liquid metal in the constriction 13, 35, 41 has such a value that the flow of the liquid metal in the constriction 13, 35, 41 is turbulent. As a result of the turbulence, the heat generated in the impingement position 29 as a result of the incidence of electrons is effectively distributed over the liquid metal flowing through the constriction 13, 35, 41, particularly in a direction transverse to the main flow direction X, so that the transfer of heat away from the impingement position 29 is improved. In the fourth embodiment shown in FIG. 6, the converging part 53, and particularly the portion 59 of the converging part 53, is provided with means for increasing the turbulence of the flow of liquid metal in the constriction 13, so that the transfer of heat away from the impingement position 29 is further improved. In the embodiment shown, said means for increasing the turbulence comprise a number of rods 67 which are arranged at regular interspaces in the converging part 53 and in the portion 59. It is noted that instead of said rods 67 other suitable means for increasing the turbulence may be used. Such means can also be used in the other embodiments of the invention shown in FIGS. 1, 3, 4, and 5. In the embodiment of FIG. 6, the distribution of the heat in the direction transverse to the main flow direction X is further improved by the presence of so-called Taylor-Goertler vortices in the constriction 13, which are characteristic of a curved flow. Since the curved flow is already present in the portion 59 of the converging part 53, said vortices will already arise in the portion 59 and will further increase in the constriction 13. In the embodiment shown, the interspaces between the rods 67 substantially correspond with the period of said Taylor-Goertler vortices during operation. In this manner, the rods 67 do not only increase the turbulence of the flow of liquid metal in the constriction 13, but also increase the Taylor-Goertler vortices in the constriction 13. As a result, the distribution of the heat in the direction transverse to the main flow direction X is further improved.

FIG. 7 shows a converging part 69, a constriction 71, and a diverging part 73 of a fifth embodiment of a device for generating X-rays according to the invention. Parts of the fifth embodiment, which correspond with parts of the first embodiment as shown in FIGS. 1 and 3, are indicated by means of corresponding reference numbers. Apart from the converging part 69, the constriction 71, and the diverging part 73, the fifth embodiment substantially corresponds with the first embodiment, and therefore the other parts of the fifth embodiment are not shown in the Figures and will not be discussed here. In the fifth embodiment, the constriction 71 is bounded by a window 75 which is concave, seen from the source 5, both in a state in which the window 75 is not deformed and in a state in which the window 75 is deformed during operation by the pressure of the liquid metal in the constriction 71. The constriction 71 is further bounded by a wall 77 opposite to the window 75. Said wall 77 has a fixed profile $p_3$ which corresponds with a profile $p_3'$ which the window 75 has, during operation, as a result of the deformation of the window 75 by the pressure of the liquid metal in the constriction 71. Thus, like in the first embodiment shown in FIG. 3, a cross-sectional area of the constriction 71 is substantially constant in the main flow direction X. It is noted, however, that the wall 77 may be provided with another profile, which matches the profile of the deformed window 75 in such a manner that during operation a different predetermined cross-sectional area, for example a cross-sectional area which increases in the main flow direction X like in the embodiment of FIG. 4, is achieved. Since the profile $p_3$ of the wall 77 corresponds with or matches the profile $p_3'$ of the deformed window 75, a center line 79 of the constriction 71 is also concave during operation, seen from the source 5, so that in the constriction 71 a concave, curved flow of the liquid metal is present. As a result, the window 75 is present near an inner radius of the curved flow, and the wall 77 is present near an outer radius of the curved flow. In this manner it is achieved that the centrifugal forces, which are exerted on the curved flow of the liquid metal in the constriction 71, are directed towards the wall 77, i.e. away from the window 75. With, for example, an average flow velocity of 50 m/s in the constriction 71, a density of the liquid metal in the order of 8000 kg/m$^3$, a distance between the window 75 and the wall 77 in the order of 250 $\mu$m, and a curvature of the center line 79 in the order of 10 mm, an additional pressure in the order of 5 bar is exerted on the wall 77 by the centrifugal forces. In this manner, an additional mechanical load on the window 75 as a result of said centrifugal forces is prevented, so that the risk of breakage of the window 75 is further reduced.

In the fifth embodiment, shown in FIG. 7, the pressure exerted during operation on the window 75 by the liquid metal is below 1 bar, particularly if the cross-sectional area of the constriction 71 increases in the main flow direction X, such that the decrease of the pressure in the flow direction X, caused by flow losses, is substantially compensated by the increase of the pressure in the flow direction X caused by the Bernoulli effect. However, when the device is started or stopped, the pressure on the window 75 may rise well above 1 bar. In order to prevent excessive deformations of the window 75, particularly when the device is started or stopped, the window 75 is provided with a plurality of corrugations 81, as shown in FIG. 8. In the embodiment shown, the corrugations 81 are mutually parallel and extend in the main flow direction X, which is perpendicular to the plane of the drawing of FIG. 8. In this way irregularities of the flow of liquid metal at the location of the window 75, such as separations of the flow, are prevented as much as possible, so that the transport of heat away from the impingement position 29 is hardly affected, or not at all, by the presence of the corrugations 81, and the increase of flow losses in the constriction 71 as a result of the presence of the corrugations 81 is limited. In the embodiment shown, the corrugations 81 each have a height h of approximately 100 $\mu$m and a width w of approximately 100 $\mu$m, and between the corrugations 81 a pitch P of approximately 1 mm is present. As a result of the presence of the corrugations 81, the mechanical stiffness of the window 75 is considerably improved, so that the deformation of the window 75 under the influence of the pressure of the liquid metal in the constriction 71 is limited, and the risk of damage or breakage of the window 75, particularly when the device is started or stopped, is further reduced. In the embodiment shown in FIG. 8, the wall 77 opposite to the window 75 is provided with a plurality of corrugations 83 which correspond with the corrugations 81 provided in the window 75, i.e. the shape of the corrugations 83 is identical to the shape of the corrugations 81 and the positions of the corrugations 83, seen in a direction Y perpendicular to the main flow direction X, are identical to the positions of the corrugations 81. In this manner it is achieved that the local distance between the window 75 and the wall 77, i.e. the local height of the constriction 71, is not influenced by the presence of the corrugations 81. As a result, the presence of the corrugations 81 does not influence the cross-sectional area of the constriction 71 and hence does not lead to local deviations of the main flow velocity and of the pressure of the liquid metal in the constriction 71.

In the embodiment of FIG. 7 with the concave window 75, the corrugations 81 are particularly suitable to prevent buckling of the window 75 under the influence of the pressure of the liquid metal in the constriction 71. It is noted that corrugations similar to the corrugations 81, or an alternative structure for increasing the stiffness of the window, may also be provided in the embodiments shown in FIGS. 3, 4, 5, and 6 in which the window 23 is convex. In these embodiments, buckling of the window 23 will not occur as a result of the fact that the window 23 is convex, but the corrugations can be used here to limit deformation of the window 23, particularly stretching of the window 23, under the influence of the pressure of the liquid metal. Instead of the corrugations 81, the window 75 in the embodiment of FIG. 7 may be provided with an alternative structure to prevent buckling of the window 75. FIG. 9 schematically shows an alternative solution to prevent buckling or deformations of the window 75 during starting or stopping of the device. This solution may be used in addition to the corrugations 81 or instead of the corrugations 81, as the corrugations 81 are mainly necessary to prevent buckling or deformation of the window 75 during starting and stopping of the device. Said solution involves the use of a plug 85 which is provided with a convex surface 87 having a profile corresponding with the profile of the window 75 when not deformed. The plug 85 can be positioned such that the convex surface 87 is in contact with the window 75. For this purpose, the device is provided with an electro-mechanical positioning device which is not shown in the Figure. The plug 85 is in a position in which it is in contact with the window 75 when the device is idle and when the device is started or stopped. When the device is started, the plug 85 will be held in contact with the window 75 as long as the pressure of the liquid metal in the constriction 71 has not yet reached its operational value below 1 bar. When the pressure has reached its operational value, the plug 85 is removed by means of said positioning device. Before the device is stopped, i.e. before the flow of the liquid metal in the constriction 71 is decelerated, the plug 85 is positioned back into contact with the window 75 by means of the positioning device.

What is claimed is:

1. A device for generating X-rays, which device comprises a source for emitting electrons accommodated in a vacuum space, a liquid metal for emitting X-rays as a result of the incidence of electrons, and a pumping means for causing a flow of the liquid metal through a constriction where the electrons emitted by the source impinge upon the liquid metal, said constriction being bounded by a window, which is transparent to electrons and X-rays and separates the constriction from the vacuum space, and by a wall opposite to the window, wherein at least during operation, said wall has a profile which matches a profile which the window has, during operation, as a result of a deformation of the window caused by a pressure of the liquid metal in the constriction.

2. A device as claimed in claim 1, wherein said wall is deformable by means of at least one actuator, the device further comprising at least one pressure sensor for measuring the pressure of the liquid metal in the constriction and a control member for controlling the actuator as a function of a pressure measured by means of the sensor.

3. A device as claimed in claim 2, wherein said actuator is a piezo-electric actuator.

4. A device as claimed in claim 1, wherein in the case of a deformation of the window, during operation, the constriction has a cross-sectional area which, seen in a flow direction, increases in such a manner that a reduction of the flow velocity in the flow direction takes place such that a decrease of the pressure of the liquid metal in the constriction, caused by viscous flow losses, substantially corresponds with an increase of said pressure caused by said reduction of the flow velocity.

5. A device as claimed in claim 1, wherein the device is provided with a flow channel for the liquid metal which successively comprises, seen in a flow direction, a converging part, said constriction, and a diverging part, wherein a center line of at least a portion of said converging part, via which the converging part is connected to the constriction, has a curvature which matches a curvature of a center line which the constriction has, during operation, in the case of a deformation of the window.

6. A device as claimed in claim 1, wherein the device is provided with a flow channel for the liquid metal which successively comprises, seen in a flow direction, a converging part, said constriction, and a diverging part, wherein the converging part is provided with means for generating or increasing a turbulence of the flow of the liquid metal in the constriction.

7. A device as claimed in claim 1, wherein a center line, which the constriction has during operation as a result of said deformation of the window, is convex, seen from the source.

8. A device as claimed in claim 1, wherein the window is concave, seen from the source.

9. A device as claimed in claim 8, wherein the window is provided with corrugations.

10. A device as claimed in claim 9, wherein said corrugations extend in a flow direction of the liquid metal in the constriction.

11. A device as claimed in claim 10, wherein the wall opposite to the window is provided with corrugations which correspond with the corrugations of the window and are in positions, seen in a direction perpendicular to the flow direction, identical to the positions of the corrugations of the window.

* * * * *